United States Patent [19]

Takiyama et al.

[11] Patent Number: 4,954,141

[45] Date of Patent: Sep. 4, 1990

[54] POLISHING PAD FOR SEMICONDUCTOR WAFERS

[75] Inventors: Masahiro Takiyama; Kunihiro Miyazaki, both of Shiojiri; Kenichiro Shiozawa, Ashiya, all of Japan

[73] Assignees: Showa Denko Kabushiki Kaisha, Tokyo; Chiyoda Kaushiki Kaisha, Osaka, both of Japan

[21] Appl. No.: 301,283

[22] Filed: Jan. 25, 1989

[30] Foreign Application Priority Data

Jan. 28, 1988 [JP] Japan ..... 63-15876

[51] Int. Cl.[5] ..... B24D 3/32; H01L 21/306

[52] U.S. Cl. ..... 51/296; 51/131.4; 51/283 R; 51/298; 51/406; 51/DIG. 34; 156/636

[58] Field of Search ..... 51/209 R, DIG. 34, 283 R, 51/298, 296, 325, 394, 406, 407, 131.4; 156/636

[56] References Cited

U.S. PATENT DOCUMENTS

| | | | |
|---|---|---|---|
| 3,504,457 | 4/1970 | Jacobsen et al. | 51/131.4 |
| 3,857,123 | 12/1974 | Walsh | 51/131.4 |
| 4,720,941 | 1/1988 | Belieff et al. | 51/298 |
| 4,841,680 | 6/1989 | Hoffstein et al. | 51/283 R |
| 4,842,678 | 6/1989 | Noro et al. | 156/636 |

FOREIGN PATENT DOCUMENTS

| | | | |
|---|---|---|---|
| 2063961 | 7/1971 | France | 156/636 |
| 0150790 | 11/1979 | Japan | 51/298 |
| 0212464 | 9/1988 | Japan | 51/131.4 |
| 268936 | 3/1971 | U.S.S.R. | 51/298 |
| 902716 | 8/1962 | United Kingdom | 51/298 |
| 2153305 | 8/1985 | United Kingdom | 51/131.4 |

*Primary Examiner*—Robert A. Rose

*Attorney, Agent, or Firm*—Sughrue, Mion, Zinn, Macpeak & Seas

[57] ABSTRACT

A polishing pad for a semiconductor wafer, which pad is made of a foamed fluorine-contained resin sheet and is highly resistant to a corrosive polishing solution such as bromine-methanol system or bromine-methanol-silica powder system.

6 Claims, 1 Drawing Sheet

POLISHING PAD FOR SEMICONDUCTOR WAFERS

BACKGROUND OF THE INVENTION

1. Field of the Invention

The present invention relates to a polishing pad for precisely and rapidly polishing a surface of a semiconductor wafer, including a wafer of an element semiconductor such as silicon and a compound semiconductor such as gallium arsenide, indium phosphide and gallium phosphide, the polishing pad having a high resistance to a corrosive etchant.

2. Description of Related Art

Conventionally, semiconductor wafers are polished by a polishing pad while supplying a polishing solution adopted for a particular semiconductor. The polishing pad includes a velour-type pad in which polyurethane resin is impregnated into a polyester nonwoven fabric and a suede-type pad in which a foamed polyurethane layer is formed on a base of a polyester nonwoven fabric.

The polishing solution used for polishing a semiconductor wafer includes a mechanochemical polishing slurry and a chemical polishing solution. The mechanochemical polishing slurry comprises abrasives and a polishing accelerator (hereinafter referred to as "etchant") and the chemical polishing solution comprises only an etchant and not abrasives. An etchant is used in both types of polishing solutions and a highly active or reactive and corrosive etchant is required for polishing a semiconductor wafer, for example, a bromine-methanol-based etchant, a hypochlorous acid-based etchant, and an amine-based etchant.

When using a highly active and corrosive etchant (hereinafter referred to as "a corrosive etchant") for polishing a semiconductor wafer, a polishing pad of either the velour-type or suede-type is corroded and the chemical and mechanical structures thereof deteriorated. As a result, the efficiency of the polishing pad is decreased, including a reduced polishing rate, an increased surface roughness, and an undulation of a polished wafer, and damage occurs to a wafer. The life time of a polishing pad is shortened when using a corrosive etchant, in comparison with using a polishing solution which is not corrosive, and it is an economical disadvantage that an expensive polishing pad must be frequently replaced by a new pad. Even when using an etchant having relatively low corrosiveness, a velour-type or suede-type pad is gradually deteriorated by the etchant over a lapse of time, and even though the pad is deteriorated, only slightly, the conditions for polishing such as a supply of an etchant, a working pressure, a rotation speed of a polishing plate, and a temperature and a flow rate of a cooling water for a polishing plate must be continuously controlled, to cope with the degree of deterioration of the pad over a period of time, to obtain a desired polished surface of a semiconductor wafer.

As described above, both velour-type and suede-type pads currently available have a low resistance to a corrosive etchant and thus have problems of polishing efficiency, workability, cost or economy.

Therefore, the main object of the present invention is to provide a polishing pad for a semiconductor wafer, which pad has an excellent polishing efficiency and a high resistance against a corrosive etchant, allowing a high polishing efficiency even after a long period of polishing with the corrosive etchant.

SUMMARY OF THE INVENTION

The inventors studied the properties of a fluorine-contained resin having an excellent chemical resistance and used a sheet of a foamed fluorine-contained resin as a polishing pad. It was found that this polishing pad had a excellent polishing capability or efficiency, including a high polishing rate and a low surface roughness of a polished semiconductor wafer, as well as a good resistance preventing a reduction of the polishing capability or efficiency and a deterioration of the pad even after a long time use thereof. As a result, the present invention provides a polishing pad for a semiconductor wafer to obtain a mirror-like surface thereof, said pad being made of a sheet of a foamed fluorine-contained resin.

The fluorine-contained resin polishing pad may be used for polishing a semiconductor wafer without previous treatment after adhering to a polishing plate, but preferably is trued before being used for polishing a semiconductor wafer. This truing enables the degree of finishing of a polished surface of a semiconductor wafer to be improved in comparison with that obtained by a polishing pad which is not trued. Namely, a flatness of the mirror-like surface of a semiconductor is better, a surface roughness thereof is smaller, and the damage thereto is less. Here, the term "truing" means polishing a surface of a pad with a hard material to remove or reduce an undulation and a roughness of that surface and obtain a very flat and smooth surface thereof.

The semiconductor wafer that can be polished to a mirror-like surface by the present invention is not particularly limited and includes any wafer of an elementary semiconductor such as silicon or a compound semiconductor such as gallium arsenide, indium phosphide and gallium phosphide. The etchant used with the polishing pad of the present invention is not particularly limited and may be any etchant suitable for a particular semiconductor wafer to be polished. Examples of the etchant are a bromine-ethanol-based etchant, a hypochlorous acid-based etchant, and an amine-based etchant.

The fluorine-contained resin used for a polishing pad of the present invention is not particularly limited and includes tetrafluoroethylene-based resin, trifluorochloroethylene-based resin, vinylidene fluoride-based resin, vinyl fluoride-based resin, or the like. An appropriate polishing pad can be prepared by controlling the conditions of foaming, including the pore size and thickness of a cell wall of a formed fluorine-contained resin sheet, depending on the kind of fluorine-contained resin. Note, although depending on the kind of a fluorine-contained resin, an average pore size of a polishing pad of a foamed fluorine-contained resin is preferably 10 μm to 2000 μm, more preferably 50 μm to 500 μm, and an average thickness of a cell wall is preferably 0.2 μm to 100 μm, more preferably 0.5 μm to 50 μm. A porosity of a polishing pad of a foamed fluorine-contained resin is preferably 60% to 95%. These conditions of a foamed sheet are preferred since they allow a very small surface roughness and a very small undulation or unevenness of a polished surface of a semiconductor wafer to be obtained and damage of a polished semiconductor wafer to be prevented.

When truing a polishing pad of the present invention, various hard materials including diamond, alumina, silicon nitride, etc., may be used, as long as they allow a surface of a fluorine-contained resin pad to be polished to a desired smoothness without roughening the surface of the pad, with diamond being particularly preferable. Diamond is conveniently used with a truing ring, on which diamond pellets produced by mixing diamond powders with powders of a metal or alloy of copper, tin, etc., followed by forming and sintering are adhered, or diamond abrasives are electrodeposited. The electrodeposition of diamond abrasives is carried out by uniformly distributing diamond abrasives on a surface of a truing ring, which is then plated by using the truing ring as an electrode to form a plating film by which the diamond abrasives are held on the surface of the truing ring. When either case adhering diamond pellets or electrodepositing diamond abrasives, the diamond particles used for truing preferably have a mesh size of 40/60 μm to 2/6 μm (#400 to #3000 of JIS), more preferably 20/40 μm to 10/20 μm (#600 to #1000). If the mesh size of the diamond is larger than 40/60 μm (#400), the resultant surface roughness of the fluorine-contained resin pad becomes large, and a mesh size of smaller than 2/6 μm (#3000) necessitates a long time for the truing. A two or more step truing process is possible, in which a pad is first trued with diamond having a large particle size to remove a large undulation or roughness and then trued with diamond having a small particle size to obtain a smooth and even surface.

According to another aspect of the present invention, there is provided a process for polishing a surface of a semiconductor wafer, the process using a polishing pad of a foamed fluorine-contained resin sheet to polish the surface of the semiconductor wafer to a mirror-like surface.

The polishing pad of a foamed fluorine-contained resin sheet according to the present invention has improved properties including a resistance to corrosion and capable of a high polishing rate, a small surface roughness and less damage to a polished wafer, even after a long time of use with a corrosive etchant.

DESCRIPTION OF THE PREFERRED EMBODIMENTS

Figure 1:
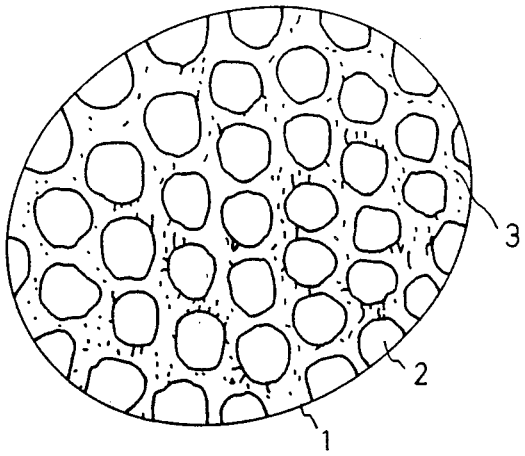
FIG. 1 is a schematic view of a polishing pad.

An example of a polishing pad of the present invention is illustrated in FIG. 1, in which reference numeral 1 denotes a surface of a polishing pad, 2 denotes a pore, 3 denotes a cell wall, and this structure is same at all angles.

Figure 2:
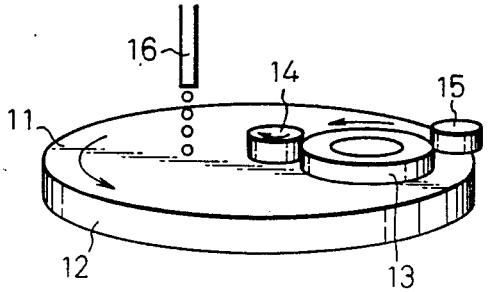
FIG. 2 is a schematic view of the truing of a polishing pad.

The truing process is described with reference to FIG. 2.

A polishing pad of a foamed fluorine-contained resin sheet 11 is adhered to a polishing plate 12, on which a truing ring 13 is placed between a center roller 14 and a guide roller 15. The truing ring 13 has a hard material such as diamond adhered to the bottom surface thereof. When the polishing pad 11 of a foamed fluorine-contained resin is adhered to the polishing plate 12, the polishing pad 11 has a considerable undulation due to a non-uniform thickness thereof, etc. This undulation is removed to obtain an even and smooth surface by rotating the polishing plate 12 and the truing ring 13 in directions indicated by the arrows in FIG. 2, while dropping pure water onto the polishing pad 11 from a pure water supply pipe 16. The truing may be carried out when a polishing pad of a foamed fluorine-contained resin sheet is adhered to a polishing plate before polishing a semiconductor wafer, and when the surface of a polishing pad of a foamed fluorine-contained resin sheet is roughened and undulated after a long polishing time, to obtain again a polishing pad of foamed fluorine-contained resin sheet having a smooth and even surface.

EXAMPLES

The present invention is further described with reference to Examples. The polishing pads used in the Examples were processed as follows. A sheet of a fluorine-contained resin was adhered to a polishing plate and then trued by a stainless steel truing ring having a diameter of 305 mm, a width (a difference between an outer diameter and an inner diameter) of 40 mm, and a thickness of 24 mm and #400 diamond pellets were adhered thereto. The truing was carried out with a surface pressure of the diamond pellets of 50 g/cm$^2$ in the dead weight manner, a rotation speed of a lower polishing plate of 80 r.p.m. and a flow rate of pure water of 2 l/min, for 20 minutes. As a result, an undulation of the surface of the polishing pad of a foamed fluorine-contained resin sheet (the definition of the surface undulation is based on JIS BO610 and excludes undulation or roughness caused by pores) was improved from 30–70 μm before truing to 6–10 μm after truing, on the basis of the entire surface of the pad. A maximum surface roughness $R_{max}$ (defined in JIS BO601 and excluding that due to pores) of the polishing pad at a standard length of 2.5 mm was improved from 20–30 μm before truing to 5–10 μm after truing. Thus, a smooth and even surface was given to a polishing pad of a foamed fluorine-contained resin sheet. The term "polishing pad of a foamed fluorine-contained resin" referred to hereinafter in the Examples means a polishing pad obtained after the truing described above.

In the following Examples, polishing was carried out using a center roller-driving one-side polishing machine with a polishing plate 720 mm in diameter. The observation and measurements in the Examples were effected as follows. The damage to a polished surface of a wafer was observed by Normarsky differential interference microscopy, the polishing rate was determined from a difference between the thickness of a semiconductor wafer before polishing and that after polishing and the surface roughness of a semiconductor wafer was determined by a Talystep and Talydata 2000 model, manufactured by Rank Taylor Hobson Company.

EXAMPLE 1

A single crystal wafer of indium phosphide was polished by a polishing pad of a foamed fluorine-contained resin. The foamed fluorine-contained resin of the polishing pad used was a foamed tetrafluoroethyleneethylene copolymer (ETFE resin) having an average pore size of 40 μm and an average cell wall thickness of 0.5 μm. The polishing pad was used for polishing under the same conditions as those for the test, for 3 hours, to observe the durability of the polishing pad after use thereof over a long period. An indium phosphide single crystal wafer having a size of 18 mm×26 mm and a face direction (100) was adhered to a polishing plate of glass having a diameter of 285 mm and was polished by the one side polishing machine. The polishing solution or etchant used was a bromine-methanol polishing solution conventionally use for polishing an indium phosphide single crystal wafer. The polishing solution had a composition of methanol to which 0.025% by volume of bromine was added. The conditions of polishing were a rotation speed of a polishing plate of 50 r.p.m., a polishing pressure of 40 g/cm$^2$, a polishing solution supply of 200 ml/min and a polishing time of 10 minutes.

The results are shown in Table 1.

EXAMPLE 2

Example 1 was repeated, except that the polishing pad of the fluorine-contained resin used was made of vinyliden fluoride-hexafluoropropylene copolymer (VDF-HFP resin) instead of the ETFE resin used in Example 1. The polishing pad was a foamed sheet having an average pore size of 100 μm and an average cell wall thickness of 1 μm.

The results are shown in Table 1.

EXAMPLE 3 (COMPARATIVE)

Example 1 was repeated, but the polishing pad of the ETFE resin used in Example 1 was replaced with a suede-type polishing pad conventionally used for polishing an indium phosphide single crystal wafer. The suede-type pad was used for polishing a wafer under the same conditions as those for the test, for 3 hours before the test.

The results are shown in Table 1.

EXAMPLE 4

Example 1 was repeated, except that the bromine-methanol polishing solution used in Example 1 was replaced by a bromine-methanol-silica powder polishing solution. The bromine-methanol-silica powder polishing solution used had a composition of methanol to which 0.025% by volume of bromine was added, and to which 5% by weight of silica powder based on the total weight of the methanol and bromine was added.

The results are shown in Table 1.

EXAMPLE 5 (COMPARATIVE)

Example 4 was repeated, except that the polishing pad of the ETFE resin used in Example 4 was replaced by a velour-type polishing pad conventionally used for polishing an indium phosphide single crystal wafer. The velour-type polishing pad was used for polishing for three hours under the same conditions as these for the test, before the test. The test was carried out in the same manner as in Example 4.

The results are shown in Table 1.

TABLE 1

| Example | Pad | Polishing solution | Polishing rate (μm/min) | Maximum surface roughness $R_{max}$ (Å) |
|---|---|---|---|---|
| 1 | Fluorine-contained resin pad (ETFE resin) | Bromine-methanol | 0.21 | 17 |
| 2 | Fluorine-contained resin pad (VDF-HFP resin) | Bromine-methanol | 0.21 | 19 |
| 3* | Suede-type pad | Bromine-methanol | 0.18 | 85 |
| 4 | Fluorine-contained resin pad (ETFE resin) | Bromine-methanol-silica powder | 0.41 | 36 |
| 5* | Velour-type pad | Bromine-methanol-silica powder | 0.35 | 97 |

*Examples 3 and 5 were comparative.

The polishing pads used in Example 1 to 5 were observed after a long period of use, to compare the durabilities of the polishing pads. The suede-type polishing pad used in Example 3 and the velour-type polishing pad used in Example 5 were corroded and partially broken by the bromine-methanol polishing solution and the bromine-methanol-silica powder polishing solution after the 3 hour polishing before the test. Particularly, the portion of the polishing pad just below the polishing solution supply pipe was remarkably broken due to a continuous contact with the corrosive polishing solution. In contrast, the fluorine-contained resin polishing pads of the ETFE resin and the VDF-HFP resin used in Examples 1, 2 and 4 were not corroded by the bromine-methanol polishing solution and the bromine-methanol-silica powder polishing solution, and had the same state or structure after the 3 hour polishing as before the polishing.

The following is a comparison of the polishing capability of the polishing pads. In Table 1, an indium phosphide single crystal wafer was polished with a bromine-methanol polishing solution in Examples 1 to 3. It is seen from Table 1 that the fluorine-contained resin polishing pad according to the present invention had a greater resistance to the corrosive polishing solution than the conventional suede-type polishing pad and preserved a high polishing rate and provided a small surface roughness even after a long period of polishing. The surfaces of the indium phosphide single crystal wafers polished by the fluorine-contained resin polishing pad and the suede-type polishing pad were observed by Normarsky differential interference microscopy at a magnitude of 87.5 times, and it was found that the surface of the wafer polished by the fluorine-contained resin polishing pad was less roughened and had less damage than the surface of the wafer polished by the suede-type polishing pad. Example 1 and 2 demonstrate that the kind of the fluorine-contained resin polishing pad is not particularly limited in the present invention.

In Table 1, an indium phosphide single crystal wafer was polished with a bromine-methanol-silica powder polishing solution in Examples 4 and 5. It is seen in Table 1 that the fluorine-contained resin polishing pad according to the present invention was more resistant to the corrosive polishing solution than the conventional velour-type polishing pad and preserved a high polishing rate and provided a small surface roughness even after a long period of polishing. The surfaces of the indium phosphide single crystal wafers were observed by Normarsky differential interference microscopy at a magnitude of 87.5 times. The surface of the wafer polished by the fluorine-contained resin polishing pad was less roughened and had much less damage than that of the wafer polished by the velour-type polishing pad.

EXAMPLE 6

A gallium arsenide single crystal wafer was polished with a fluorine-contained resin polishing pad.

The fluorine-contained resin of the polishing pad was a foamed ETFE resin having an average pore size of 40 μm and an average cell wall thickness of 0.5 μm. Before the test, the polishing pad was used under the same conditions as those for the test to conduct the test after the polishing pad was used for a long time. A gallium arsenide single crystal wafer having a diameter of 2 inches and a face direction of (100) was adhered to a polishing plate of glass having a diameter of 285 mm by a wax, and polishing was carried out by a one side polishing machine. The polishing solution used was a polishing solution for gallium arsenide, SHOPOLISH G-1000 (containing an etchant only and not containing abrasives, the main ingredient of the etchant being a hypochlorous acid compound) manufactured by SHOWA DENKO Co., Ltd., which was dissolved into pure water to a predetermined concentration. The polishing conditions were a rotation speed of a polishing plate of 50 r.p.m., a polishing pressure of 40 g/cm$^2$, a polishing solution supply of 90 ml/min, and a polishing time of 10 minutes.

The results are shown in Table 2.

EXAMPLE 7 (COMPARATIVE)

Example 6 was repeated, except that the polishing pad of the ETFE resin used in Example 6 was replaced by a suede-type polishing pad conventionally used for polishing a gallium arsenide single crystal wafer. The suede-type polishing pad was used for polishing for 6 hours under the same conditions as those of the test, before the test.

The result are shown in Table 2.

TABLE 2

| Example | Pad | Polishing solution | Polishing rate (μm/min) | Maximum surface roughness $R_{max}$ (Å) |
|---|---|---|---|---|
| 6 | Fluorine-contained resin pad (ETFE resin) | G-1000 | 0.43 | 22 |
| 7* | Suede-type pad | G-1000 | 0.38 | 63 |

*Example 7 was comparative.

The polishing pads used in Examples 6 and 7 were observed after a long period of use to compare the durabilities of the polishing pads. The suede-type polishing pad was corroded by the polishing solution for gallium arsenide and hardened after the 6 hour polishing before the test. A portion of a nap layer portion of the foamed layer of the suede-type polishing pad was partially broken at that time. In contrast, even after 6 hours polishing of the test, the fluorine-contained resin polishing pad of the ETFE resin used in Example 6 was not corroded by the corrosive polishing solution and preserved the state of the polishing pad before use.

It is seen in Table 2 that the fluorine-contained resin polishing pad according to the present invention was more resistance to the corrosive polishing solution than the conventional suede-type polishing pad and preserved a high polishing rate and provided a small surface roughness after a long period of polishing. The surfaces of the gallium arsenide single crystal wafers polished in Examples 6 and 7 were observed by Normarsky differential interference microscopy at a magnitude of 87.5 times, and was found that the surface of the wafer polished by the fluorine-contained resin polishing pad in Example 6 was less roughened and had less damage than the surface of the wafer polished by the suede-type polishing pad in Example 7.

We claim:

1. A polishing pad for obtaining a mirror-like surface of a semiconductor wafer, said pad comprising a sheet of foamed fluorine-containing resin, wherein said pad of said foamed fluorine-containing resin has an average pore size of 10 to 2000 μm and porosity of 60 to 95%.

2. A pad according to claim 1, wherein said fluorine-containing resin is selected from the group consisting of tetrafluoroethylene-based resin, trifluorochloroethylene-based resin, vinylidene fluoride-based resin, and vinyl fluoride-based resin.

3. A pad according to claim 1, wherein said average pore size is from 50 μm to 500 μm.

4. A pad according to claim 1, wherein an average thickness of a cell wall of said foamed fluorine-containing resin is from 0.2 μm to 100 μm.

5. A pad according to claim 4, wherein said average thickness of a cell wall is from 0.5 μm to 50 μm.

6. A pad according to claim 1, wherein said foamed fluorine-containing resin sheet is adhered to a polishing plate and an exposed surface of the foamed fluorine-containing resin sheet is trued.

* * * * *